US008454482B2

(12) United States Patent
Chang

(10) Patent No.: US 8,454,482 B2
(45) Date of Patent: Jun. 4, 2013

(54) BODY CONTOURING APPARATUS AND THE METHOD THEREOF

(76) Inventor: Shuo-Hsiu Johnny Chang, Taipei (TW)

( * ) Notice: Subject to any disclaimer, the term of this patent is extended or adjusted under 35 U.S.C. 154(b) by 196 days.

(21) Appl. No.: 12/833,647

(22) Filed: Jul. 9, 2010

(65) Prior Publication Data

US 2012/0010056 A1 Jan. 12, 2012

(51) Int. Cl.

| | |
|---|---|
| ***A63B 21/002*** | (2006.01) |
| ***A63B 21/072*** | (2006.01) |
| ***A63B 21/075*** | (2006.01) |
| ***A63B 21/02*** | (2006.01) |

(52) U.S. Cl.

USPC ..... 482/91; 482/107; 482/121; 482/122; 482/126

(58) Field of Classification Search

USPC ..... 482/10, 23, 44, 51, 74, 77, 91–94, 482/97–99, 105, 107, 109–110, 121–122, 482/124–126, 131, 139

See application file for complete search history.

(56) References Cited

U.S. PATENT DOCUMENTS

| | | | | |
|---|---|---|---|---|
| 4,690,401 | A * | 9/1987 | Cho | 482/122 |
| 5,004,226 | A * | 4/1991 | Brown, Jr. | 482/126 |
| D344,995 | S | 3/1994 | Sheppard | |
| 5,735,781 | A | 4/1998 | Pai | |
| 5,807,217 | A | 9/1998 | Endelman | |
| 5,891,003 | A * | 4/1999 | Deac et al. | 482/106 |
| 5,897,469 | A * | 4/1999 | Yalch | 482/109 |
| 6,733,427 | B1 | 5/2004 | He | |
| 6,932,747 | B2 | 8/2005 | Herman | |
| 7,448,990 | B2 * | 11/2008 | Wu | 482/121 |
| 7,704,198 | B2 * | 4/2010 | Brown, Jr. | 482/121 |
| 7,708,671 | B2 * | 5/2010 | Burkhardt | 482/92 |
| 2006/0276309 | A1 * | 12/2006 | Ko | 482/91 |
| 2007/0135275 | A1 * | 6/2007 | Oates | 482/109 |

* cited by examiner

*Primary Examiner* — Oren Ginsberg
(74) *Attorney, Agent, or Firm* — WPAT, PC; Justin King

(57) ABSTRACT

A body contouring apparatus and the method for using such apparatus is provided. The apparatus comprises a flexible rod, which has two ends and a laminar cross-section. The exercise device can switch between a rod shape and a ring shape. The exercise device has two connecting components, which are disposed at the two ends of the flexible rod, and at least one handle portion, which is female-connected to the flexible rod. When the two connecting components are connected to each other, the exercise device is in a ring shape; and when the two connecting components are not connected to each other, the exercise device is in a rod shape.

16 Claims, 7 Drawing Sheets

BODY CONTOURING APPARATUS AND THE METHOD THEREOF

BACKGROUND OF THE INVENTION

1. Field of the Invention

The present invention generally relates to an exercise device, more particularly to a body contouring apparatus and the method thereof. The exercise device can switch between a ring shape and a rod shape for performing different exercises and being easily transported.

2. Description of the Prior Art

Health is the most important object to human beings, no matter rich or poor people. When a man or a woman is in the middle ages as between 40 and 60, a daily exercise is a must in order to maintain health. Otherwise, diseases, such as diabetes, high blood pressure, gallstones, etc, may occur.

Due to that the busy urban life style, people generally have very limited time, spaces, tools, etc. to exercise and stretch their bodies and muscle. Hence, some related merchandise is then produced. Some prior arts as U.S. Pat. No. 6,733,427, U.S. Pat. No. 5,807,217, U.S. Pat. No. 5,735,781, and U.S. Pat. No. 6,932,747 are all related products. These prior arts are all shaped as a circle, hardly to be carried around, and at a higher manufacturing cost. It is not ideal for anyone to travel with those conventional exercise devices which has the fixed physical structure and limited exercise functions.

Hence, there is a need for a body shaper that is light, tiny, easy-to-go, and inexpensive.

SUMMARY OF THE INVENTION

The main objective of the present invention is to provide an exercise device that is light, tiny, easy-to-go, multiple exercising functions, and inexpensive.

The exercise device comprises a flexible rod, two connecting components, and at least one handle portion. The flexible rod has two ends and a laminar cross-section body. The two connecting components are disposed at the two ends of the flexible rod. The at least one handle portion is female-connected to the flexible rod. The two connecting components are able to be connected to each other so the exercise device can form a ring shape or a figure selected from one of an ellipse and an 8-type shape.

Other and further features, advantages, and benefits of the invention will become apparent in the following description taken in conjunction with the following drawings. It is to be understood that the foregoing general description and following detailed description are exemplary and explanatory but are not to be restrictive of the invention. The accompanying drawings are incorporated in and constitute a part of this application and, together with the description, serve to explain the principles of the invention in general terms. Like numerals refer to like parts throughout the disclosure.

BRIEF DESCRIPTION OF THE DRAWINGS

The objects, spirits, and advantages of the preferred embodiments of the present invention will be readily understood by the accompanying drawings and detailed descriptions, wherein.

DETAILED DESCRIPTION OF THE INVENTION

Following preferred embodiments and figures will be described in detail so as to achieve aforesaid objects.

Figure 1:
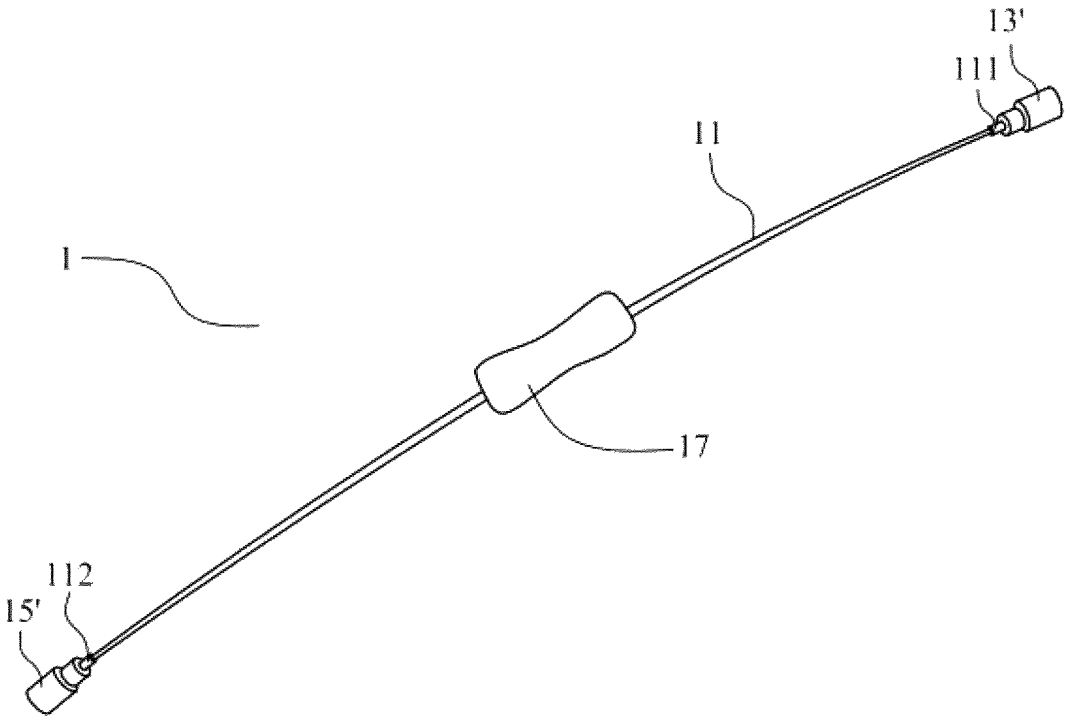
FIG. 1 illustrates a schematic view of a preferred embodiment of the present invention.

Referring to FIG. 1, which illustrates a schematic view of a preferred embodiment of the present invention of the present invention in a rod shape. The exercise device 1 includes a flexible rod 11 with two ends 111 and 112, and at least one handle portions 17. The at least one handle portion 17 is female-connected to the flexible rod 11 and made of foam. The FIG. 1 also shows two weight members 13' and 15' attached at each end of the flexible rod respectively. The weight members 13' and 15' are connected to the flexible rod 11 via two connecting components 13 and 15 (not shown in FIG. 1).

Figure 2:
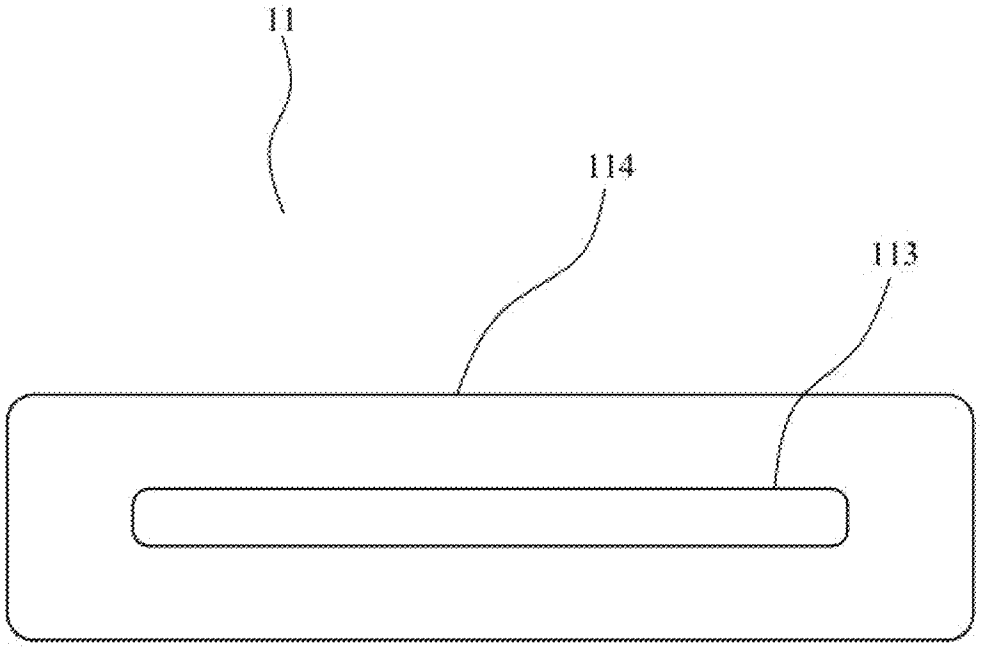
FIG. 2 illustrates a schematic view of a cross-section of a flexible rod of the preferred embodiment of the present invention.

Referring to the FIG. 2, which illustrates a laminar cross-section view of the flexible rod 11. The flexible rod 11 comprises an axis 113 and a layer 114. The axis 113 can be made of fiberglass, and the layer 114 can be made of PVC.

Figure 3B:
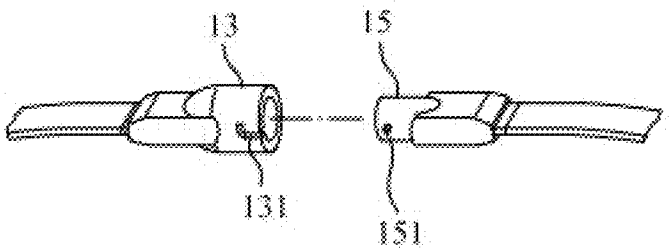
FIG. 3A to FIG. 3B illustrate two sequential views of dismantling the two joined connecting components of the preferred embodiment of the present invention.
Figure 3A:
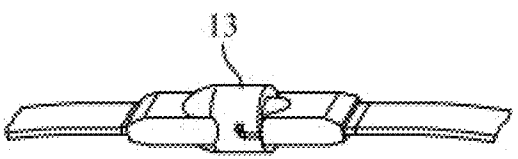

With references to FIG. 3A and FIG. 3B, which illustrate two sequential views of dismantling the two joined connecting components of the preferred embodiment of the present invention. As shown in the two figures, FIG. 3A shows that the two connecting components 13 and 15 are joined together through the way of tenon, and FIG. 3B represent that the two connecting components 13 and 15 are dismantled, wherein an L-shape aperture 131 and a protrusion 151 are specially designed for the way of tenon. The two connecting components 13 and 15 can be made of acrylonitrile butadiene styrene (ABS). In an alternative embodiment, the connecting component 15 is flat rather than cylindrical as shown in FIG. 3B, which enables the two components 13 and 15 to pivot up and down. By connecting the connecting components 13 and 15, the exercise device 1 can form into a ring shape.

Figure 4:
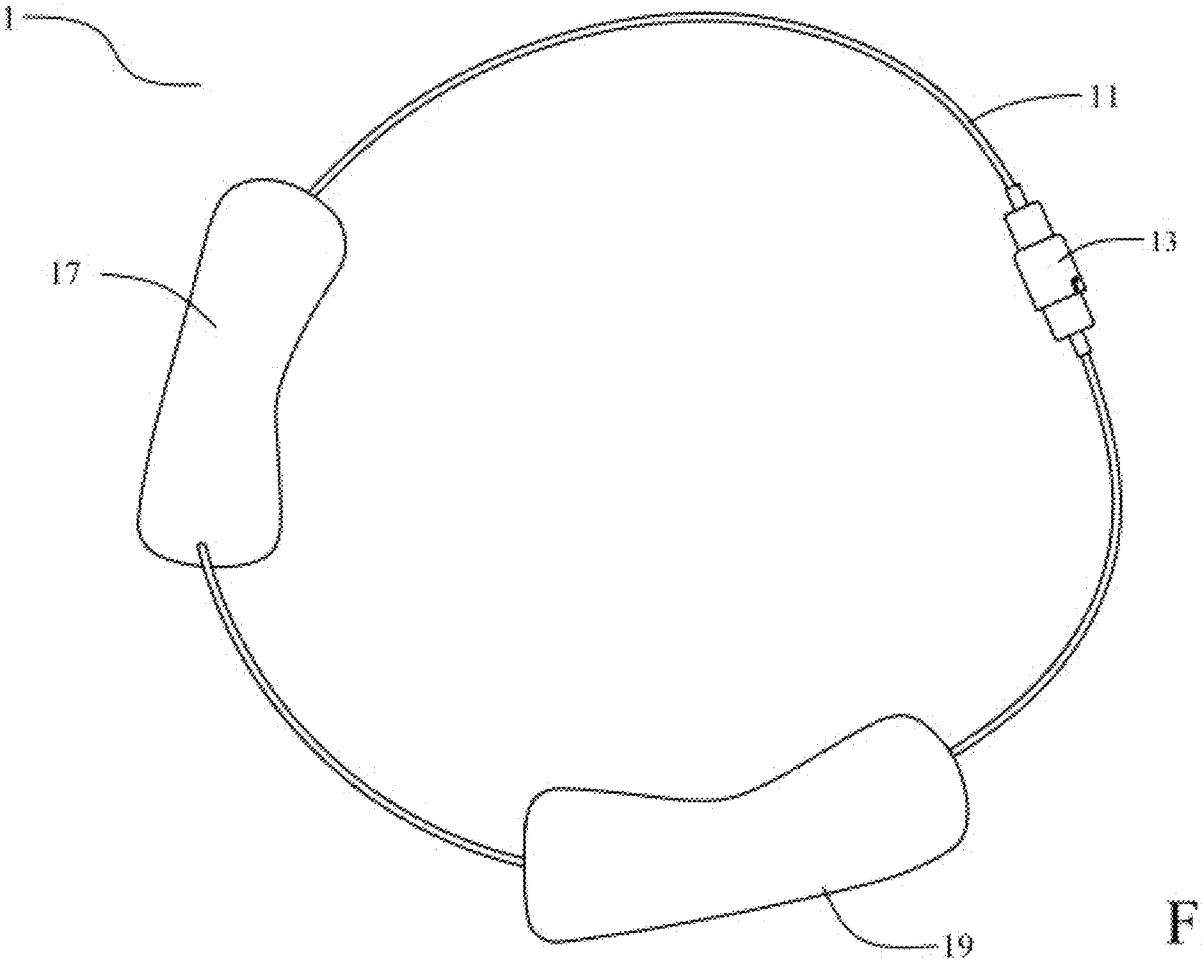
FIG. 4 illustrates a schematic view of the assembled preferred embodiment of the present invention.

The FIG. 4 illustrates a schematic view of the assembled preferred embodiment of the present invention in a ring shape. As shown in FIG. 4, the exercise device 1 has the flexible rod 11, the two joined connecting components 13 and 15 (the connecting component 15 is not shown in FIG. 4, since the connecting component 15 is inserted into and wrapped around by the connecting component 13), and the two handle portions 17 and 19. Wherein the two handle portions 17 and 19 are two force-applied positions by two hands or two legs of a human being for exercising the body. The handle portions 17 and 19 can be move along the flexible rod 11, so the user can move the handle portions 17 or 19 to cover the connecting component 13/15 while the user is using the exercise device 1 in a ring shape. User can also remove the handle portions 17 or 19 from the exercise device 1 while the user is using the exercise device 1 in a rod shape.

Figure 5B:
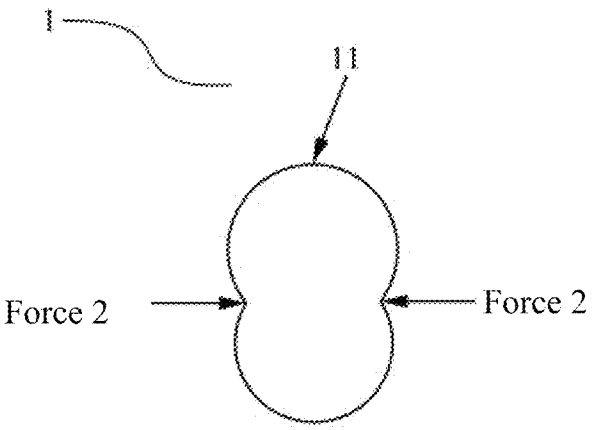
FIG. 5A and FIG. 5B illustrate two schematic deformation views of two external forces applied to the preferred embodiment of the present invention.
Figure 5A:
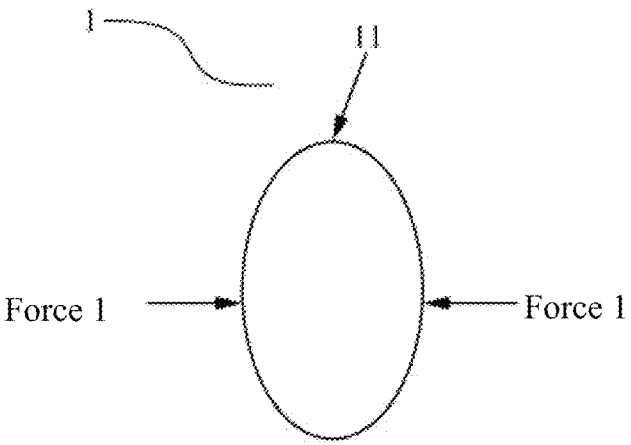

With references to FIG. 5A and FIG. 5B, which illustrate two schematic deformation views of two external forces applied to the preferred embodiment of the present invention. When the two connecting components 13 and 15 are connected to each other, and users are exercising by applying force onto the connected flexible rod 11, the connected flexible rod 11 is then deformed as a figure selected from one of an ellipse and an 8-type shape. When user applies a smaller force, the force F1, onto the flexible rod 11, the connected flexible rod 11 is then shaped into an ellipse. When user applies a larger force, the force F2, onto the flexible rod 11, the connected flexible rod 11 is then shaped into a shape of number 8.

Figure 6A:
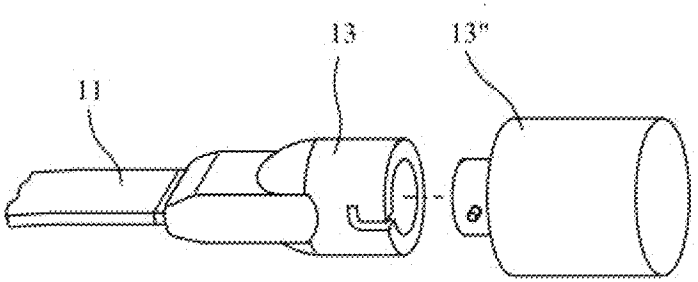
FIG. 6A and FIG. 6B illustrate a schematic view of the relationships between a connecting component and a weight member and another schematic view of the relationships between another connecting component and another weight member respectively while the preferred embodiment is not assembled.
Figure 6B:
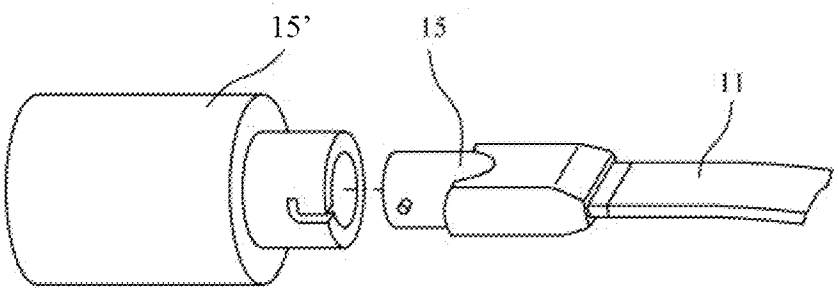
Figure 7A:
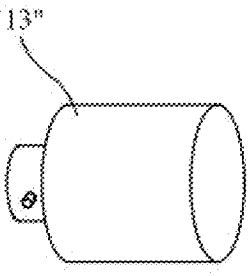
FIG. 7A and FIG. 7B illustrate a detail schematic view of the weight member and another detail schematic view of the other weight member of the present invention.
Figure 7B:
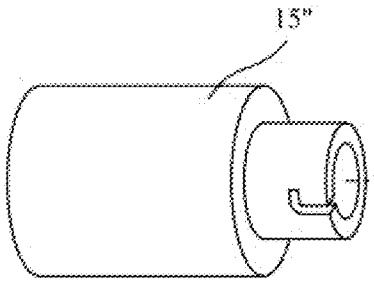

With references to FIG. 6A and FIG. 6B, which illustrate a schematic view of the relationships between the connecting component 13 and the weight member 13' and another schematic view of the relationships between the connecting component 15 and the weight member 15' respectively while the preferred embodiment is in a rod shape as shown in FIG. 1. As shown in the FIG. 1, each end of the flexible rod 11 is connected with one of the weight members 13' and 15'. Further, FIG. 7A and FIG. 7B illustrate a detail schematic view of the weight member 13' and a detail schematic view of the weight member 15' of the present invention. By connecting the weight members on each end of the flexible rod, user can use the current exercise device and an exercise rod.

As it can be seen, the present invention can be easily taken apart for easily transported. Further, the materials and the component structural design provide the present invention with the advantages of light, tiny, easy-to-go, and inexpensive.

Although the invention has been disclosed and illustrated with reference to particular embodiments, the principles involved are susceptible for use in numerous other embodiments that will be apparent to persons skilled in the art. This invention is, therefore, to be limited only as indicated by the scope of the appended claims

What is claimed is:

1. An exercise device comprising:

a flexible rod, having a first end, a second end, and a rectangular sectional shape;

a first connecting component coupled to said first end, wherein said first connecting component comprises a first rectangular block, a female cylinder connector, and an L-shape exposed aperture on said female cylinder connector, and said first rectangular block connects said female cylinder connector to said first end; and a second connecting component coupled to said second end, wherein said second connecting component comprises a second rectangular block, a male cylinder connector, and a protrusion on said male cylinder connector for locking into said L-shape exposed aperture, and said second rectangular block connects said male cylinder connector to said second end.

2. The exercise device according to claim 1, wherein said flexible rod comprises an outer PVC layer wrapping around an inner fiberglass axis.

3. The exercise device according to claim 1, wherein said first connecting component and said second connecting component are made of acrylonitrile butadiene styrene (ABS).

4. The exercise device according to claim 1, wherein said first connecting component is connected with a first weight and said second connecting component is connected with a second weight when said first connecting component is not connecting to said second connecting component.

5. The exercise device according to claim 1, further comprising a handle portion.

6. The exercise device according to claim 5, wherein said handle portion is made of foam.

7. The exercise device according to claim 5, wherein said handle portion is female-connected to said flexible rod.

8. The exercise device according to claim 1, an external force is applied onto said flexible rod when said first connecting component is connecting to said second connecting component, said flexible rod is deformed into a shape selected from an ellipse and a number-8 shape.

9. A method for using a dual-purpose exercising device, comprising:

providing a flexible rod, having a first end and a second end, with a rectangular sectional shape;

providing a first connecting component coupled to said first end, wherein said first connecting component comprises a first rectangular block, a female cylinder connector, and an L-shape exposed aperture on said female cylinder connector, and said first rectangular block connects said female cylinder connector to said first end;

providing a second connecting component coupled to said second end, wherein said second connecting component comprises a second rectangular block, a male cylinder connector, and a protrusion on said male cylinder connector, and said second rectangular block connects said male cylinder connector to said second end; and connecting said first connecting component to said second connecting component to use said dual-purpose exercise device as an exercise ring by inserting said male cylinder connector into said female cylinder connector to enable said protrusion locked into said L-shape exposed aperture, or disconnecting said first connecting component from said second connecting component to use said dual-purpose exercise device as an exercise rod by separating said male cylinder connector away from said female cylinder connector to unlock said protrusion from said L-shape exposed aperture.

10. The method according to claim 9, further comprises:

providing said flexible rod with an outer PVC layer wrapper around an inner fiber axis.

11. The method according to claim 9, further comprises:

providing said first connecting component and said second connecting component being made of acrylonitrile butadiene styrene (ABS).

12. The method according to claim 9, further comprises:

connecting said first connecting component to a first weight when said first connecting component is not connecting to said second connecting component; and connecting said second connecting component to a second weight when said first connecting component is not connecting to said second connecting component.

13. The method according to claim 9, further comprising:

providing a handle portion.

14. The method according to claim 13, further comprises:

providing said handle portion being made of foam.

15. The method according to claim 13, further comprises:

female-connecting said handle portion to said flexible rod.

16. The method according to claim 9, further comprises:

applying an external force onto said dual-purpose exercising device to deform said flexible rod into a shape selected from an ellipse and a number-8 shape when said first connecting component is connecting to said second connecting component.

* * * * *